US012392341B2

(12) United States Patent
Arashi et al.

(10) Patent No.: US 12,392,341 B2
(45) Date of Patent: Aug. 19, 2025

(54) COMPRESSOR

(71) Applicant: MITSUBISHI HEAVY INDUSTRIES THERMAL SYSTEMS, LTD., Tokyo (JP)

(72) Inventors: Noriaki Arashi, Tokyo (JP); Ichiro Yogo, Tokyo (JP); Yuki Ichise, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 18/852,562

(22) PCT Filed: Apr. 21, 2023

(86) PCT No.: PCT/JP2023/015913
§ 371 (c)(1),
(2) Date: Sep. 30, 2024

(87) PCT Pub. No.: WO2023/204301
PCT Pub. Date: Oct. 26, 2023

(65) Prior Publication Data

US 2025/0101982 A1 Mar. 27, 2025

(30) Foreign Application Priority Data

Apr. 21, 2022 (JP) ..... 2022-070173

(51) Int. Cl.
*F04C 27/00* (2006.01)
*F04C 29/02* (2006.01)

(52) U.S. Cl.
CPC ..... *F04C 27/001* (2013.01); *F04C 29/02* (2013.01); *F04C 2210/26* (2013.01)

(58) Field of Classification Search
CPC ..... F04B 39/00; F04B 39/121; F04C 27/00
See application file for complete search history.

(56) References Cited

U.S. PATENT DOCUMENTS

2018/0292008 A1 10/2018 Fujita et al.
2020/0232462 A1 7/2020 Park et al.
2022/0173626 A1 6/2022 Hagita et al.

FOREIGN PATENT DOCUMENTS

DE 11 2020 001120 T5 12/2021
JP 2005-090626 A 4/2005
(Continued)

OTHER PUBLICATIONS

International Search Report (PCT/ISA/210) issued in PCT/JP2023/015913, dated Jul. 11, 2023.
(Continued)

*Primary Examiner* — Anthony Ayala Delgado
(74) *Attorney, Agent, or Firm* — Birch, Stewart, Kolasch & Birch, LLP

(57) ABSTRACT

An embodiment includes: a cylindrical motor case surrounding a compression mechanism about an axis; a lower case closing an opening of the motor case, fitted to an inner circumferential face of the motor case, and defining an accommodation chamber between the motor case and the lower case where a refrigerant is introduced; a first O-ring provided about the axis at a facing portion where the motor case and the lower case fitted to each other face each other in a plane; and a second O-ring provided about the axis in the facing portion, the first O-ring is provided at a position closer to a starting point on the accommodation chamber side of the facing portion than the second O-ring, the first O-ring has better refrigerant resistance and/or oil resistance than the second O-ring, and the second O-ring has better sealing performance than the first O-ring at a temperature of −20° C. or lower.

5 Claims, 5 Drawing Sheets

(56) References Cited

FOREIGN PATENT DOCUMENTS

| | | | |
|---|---|---|---|
| JP | 2005-240676 | A | 9/2005 |
| JP | 2005-282551 | A | 10/2005 |
| JP | 2009-091986 | A | 4/2009 |
| JP | 2016-151256 | A | 8/2016 |
| JP | 2020-143650 | A | 9/2020 |
| JP | 2022-053976 | A | 4/2022 |

OTHER PUBLICATIONS

Extended European Search Report issued Jun. 13, 2025 in corresponding European Patent Application No. 23791949.3.

COMPRESSOR

TECHNICAL FIELD

The present disclosure relates to a compressor.

BACKGROUND ART

For electric compressors in which one casing is formed of a plurality of cases, a seal member such as an O-ring may be provided between one case and another case to ensure sealing performance between the cases.

For example, in Patent Literature 1, two O-rings aligned in the axis direction are provided between one case and another case.

CITATION LIST

Patent Literature

[PTL 1]
Japanese Patent Application Laid-Open No. 2020-143650

SUMMARY OF INVENTION

Technical Problem

A seal member arranged at a position that is likely to be subjected to contact with the refrigerant is required to have refrigerant resistance and/or oil resistance, but some seal members that meet these requirements exhibit reduced sealing performance at low temperatures (when exposed to an environment at a temperature of −20° C. or lower, for example).

The present disclosure has been made in view of such circumstances and intends to provide a compressor that can maintain sealing performance at low temperatures.

Solution to Problem

To solve the above problem, the compressor of the present disclosure employs the following solution.

A compressor according to one aspect of the present disclosure includes: a cylindrical main case surrounding a compression mechanism about an axis, the compression mechanism being configured to compress a refrigerant; a sub-case closing an opening of the main case in a direction of the axis, fitted to an inner circumferential face or an outer circumferential face of the main case, and defining a space between the main case and the sub-case, the refrigerant being introduced to the space; an annular first seal member provided about the axis at a facing portion where the main case and the sub-case fitted to each other face each other in a plane; and an annular second seal member provided about the axis in the facing portion, the first seal member is provided at a position closer to a starting point on the space side of the facing portion than the second seal member, the first seal member has better refrigerant resistance and/or oil resistance than the second seal member, and the second seal member has better sealing performance than the first seal member at a temperature of −20° C. or lower.

Advantageous Effects of Invention

According to the present disclosure, it is possible to maintain sealing performance at low temperatures.

DESCRIPTION OF EMBODIMENTS

A compressor according to one embodiment of the present disclosure will be described below with reference to the drawings.

[Overview of Compressor]

A compressor 10 is an apparatus to compress a refrigerant (for example, R1234yf) containing a refrigeration oil (for example, POE oil).

Note that the following description uses, as an example of the compressor 10, a scroll compressor in which a compression mechanism 200 and an electric motor 400 serving as a driving unit are accommodated in the internal space of a casing 100 that is an enclosed space, but the compressor 10 may be a so-called open-type scroll compressor in which the driving unit is arranged outside the enclosed space.

Figure 1:
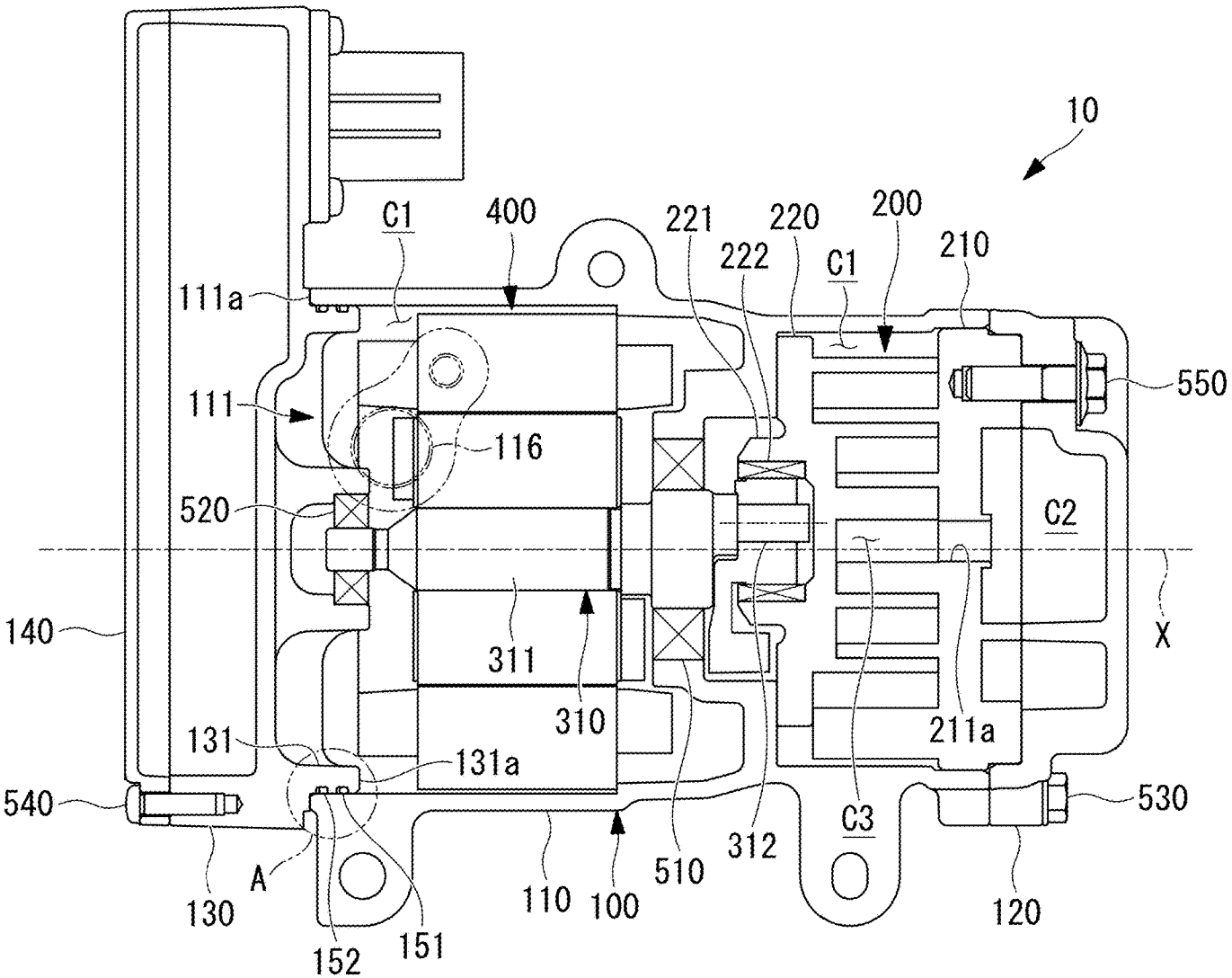
FIG. 1 is a longitudinal sectional view of a compressor according to one form of the present disclosure.

As illustrated in FIG. 1, the compressor 10 includes the casing 100, the compression mechanism 200, a crankshaft 310, and the electric motor 400.

The casing 100 has a motor case (main case) 110, an upper case 120, and a lower case (sub-case) 130.

The motor case 110 is a cylindrical member extending in the direction of an axis X and opened at both ends.

The motor case 110 surrounds the compression mechanism 200, the crankshaft 310, and the electric motor 400 about the axis X.

The upper case 120 is a member that closes one opening of the motor case 110.

The upper case 120 is fixed to the motor case 110 by a bolt 530.

The lower case 130 is a member that closes the other opening (hereinafter referred to as "opening 111") of the motor case 110.

The lower case 130 is fixed to the motor case 110 by a bolt (not illustrated). The detailed configuration of a portion where the motor case 110 and the lower case 130 are fitted to each other will be described later.

An inverter cover 140 is attached to the lower case 130 by a screw 540. An inverter (not illustrated) is accommodated in a space defined by the lower case 130 and the inverter cover 140.

In an enclosed space defined by the casing 100 (the motor case 110, the upper case 120, and the lower case 130) configured as described above, the compression mechanism 200, the crankshaft 310, the electric motor 400, and various other components are accommodated.

The compression mechanism 200 is a mechanism that compresses a low-pressure gas refrigerant taken in from outside of the casing 100 through a suction port 116.

The compression mechanism 200 has a fixed scroll 210 and an orbiting scroll 220.

The fixed scroll 210 is a member having a fixed side end plate and a spiral fixed side wall body erected from the end plate.

The fixed scroll 210 is fixed to the upper case 120 by a bolt 550. Further, the outer circumferential face of the fixed side end plate of the fixed scroll 210 is in contact with the inner circumferential face of the motor case 110 and the inner circumferential face of the upper case 120 while maintaining its sealing performance. Accordingly, the enclosed space inside the casing 100 is divided into an accommodation chamber C1 which is defined by the fixed scroll 210, the motor case 110, and the lower case 130 and a discharge chamber C2 which is defined by the fixed scroll 210 and the upper case 120.

Note that the sealing performance between the fixed scroll 210 and the motor case 110 and the sealing performance between the fixed scroll 210 and the upper case 120 are ensured by O-rings, for example.

The orbiting scroll 220 is a member having an orbiting side end plate and a spiral orbiting side wall body erected from the end plate.

The orbiting scroll 220 is configured to perform revolution movement with respect to the fixed scroll 210 by the crankshaft 310 rotated about the axis X (in detail, a crankpin 312 revolved about the axis X) and a known anti-rotation mechanism.

Respective wall bodies of the fixed scroll 210 and the orbiting scroll 220 are engaged with each other, and thereby the fixed scroll 210 and the orbiting scroll 220 form a compression chamber C3.

The crankshaft 310 is a member for transmitting driving force from the electric motor 400 to the orbiting scroll 220.

The crankshaft 310 has a shaft body 311 and the crankpin 312.

The shaft body 311 is a shaft-like member extending along the axis X. The shaft body 311 is driven and rotated about the axis X by the electric motor 400.

The shaft body 311 is supported rotatably about the axis X by a main bearing 510, which is arranged on the upper case 120 side and fixed to the motor case 110, and by a sub-bearing 520, which is arranged on the lower case 130 side and fixed to the lower case 130.

The crankpin 312 is a shaft-like member provided at an end on the upper case 120 side of the shaft body 311.

The crankpin 312 extends along another axis eccentric from the axis X. Thus, when the shaft body 311 is rotated about the axis X, the crankpin 312 is revolved about the axis X.

The crankpin 312 is connected via a bearing 222 to a boss part 221 formed in the orbiting scroll 220.

The compressor 10 configured as described above is driven as follows.

The shaft body 311 of the crankshaft 310 is driven and rotated about the axis X by the electric motor 400, and thereby the orbiting scroll 220 connected to the crankpin 312 is driven.

A gas refrigerant taken into the accommodation chamber C1 on the lower case 130 side via the suction port 116 passes through a refrigerant passage or the like formed between the inner circumferential face of the motor case 110 and the outer circumferential face of the electric motor 400 (stator), and the gas refrigerant is guided to the accommodation chamber C1 on the compression mechanism 200 side.

The refrigerant guided to the accommodation chamber C1 on the compression mechanism 200 side is taken into the compression chamber C3. At this time, the compression chamber C3 is configured so that the volume thereof is gradually reduced in accordance with the revolution movement of the orbiting scroll 220, and thus the gas refrigerant is compressed accordingly.

The compressed high-temperature high-pressure gas refrigerant is guided to the discharge chamber C2 via a discharge port 211*a* formed in the approximate center of the fixed side end plate of the fixed scroll 210 and the discharge valve (not illustrated) provided at the outlet of the discharge port 211*a*.

The gas refrigerant guided to the discharge chamber C2 is discharged to outside of the compressor 10 via the discharge port (not illustrated) provided in the upper case 120.

[Engagement Portion Between Motor Case and Lower Case]

Figure 2:
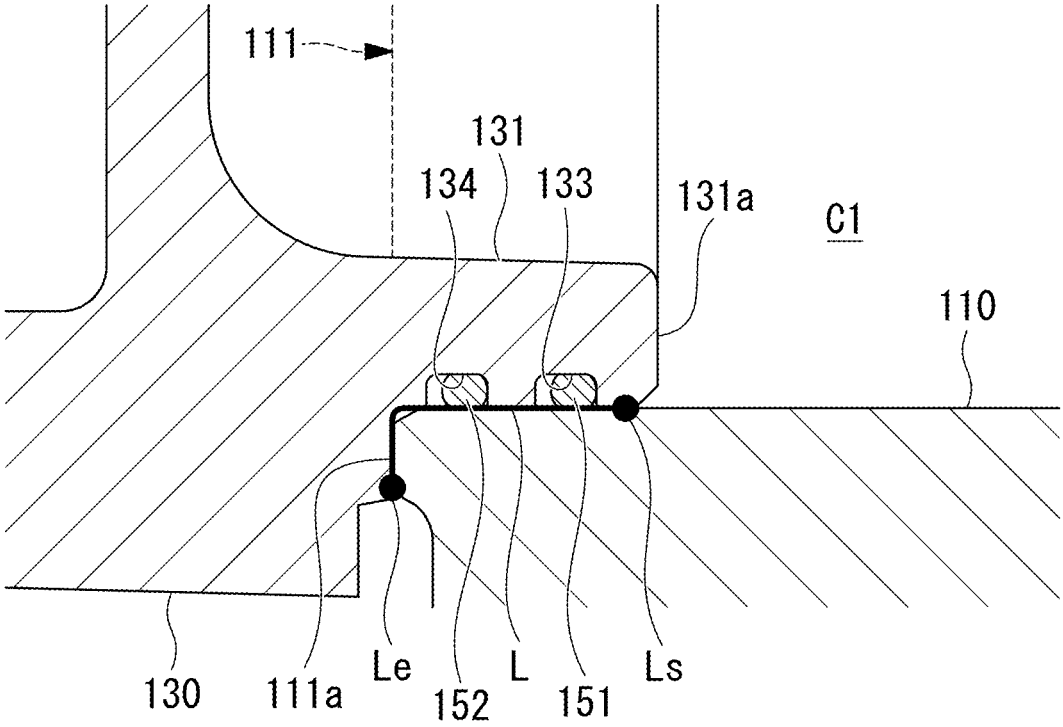
FIG. 2 is a partial enlarged view of the part A illustrated in FIG. 1.

As illustrated in FIG. 1 and FIG. 2, an annular protruding portion 131 is formed in the lower case 130.

The annular protruding portion 131 is a portion formed in the lower case 130 facing the opening 111 of the motor case 110.

The annular protruding portion 131 protrudes in the direction of the axis X, is formed in an annular shape about the axis X, and is fitted to the inner circumferential face of the opening 111. Thus, the outer diameter of the annular protruding portion 131 corresponds to the inner diameter of the opening 111.

In a state where the motor case 110 and the lower case 130 are fitted to each other, two seal members (a first O-ring 151 and a second O-ring 152) are provided in any range of a portion where the motor case 110 and the lower case 130 face each other in a plane. In detail, the portion means a portion where a portion on the opening 111 side of the motor case 110 and the annular protruding portion 131 of the lower case 130 face each other in a plane (hereinafter referred to as a "facing portion L").

The first O-ring 151 is a seal member having rubber elasticity and having an annular shape about the axis X. Further, the second O-ring 152 is a seal member having rubber elasticity and having an annular shape about the axis X.

Note that the first O-ring 151 and the second O-ring 152 are formed of different materials from each other. The detail thereof will be described later.

For example, the first O-ring 151 is provided in a first annular groove 133 formed in the outer circumferential face of the annular protruding portion 131. Further, for example, the second O-ring 152 is provided in a second annular groove 134 formed in the outer circumferential face of the annular protruding portion 131.

Note that the first O-ring 151 and the second O-ring 152 being assembled into the compressor 10 are in close contact with the motor case 110 and lower case 130, respectively, and are compressed and squeezed between the motor case 110 and lower case 130.

Herein, the first annular groove 133 is formed at a position closer to a starting point Ls of the facing portion L than the second annular groove 134 (a position away from an end point Le of the facing portion L). In other words, the first O-ring 151 is provided at a position closer to the starting point Ls of the facing portion L than the second O-ring 152 (a position away from the end point Le of the facing portion L).

Herein, the starting point Ls of the facing portion L is a point (portion) of the facing portion L in contact with and adjacent to the accommodation chamber C1. Further, the end point Le of the facing portion L is a point (portion) of the facing portion L in contact with and adjacent to the outside of the compressor 10.

In the case of FIG. 2, the starting point Ls of the facing portion L is located on an end face 131*a* side of the annular protruding portion 131. Thus, the first annular groove 133 is formed at a position closer to the end face 131*a* of the annular protruding portion 131 than the second annular groove 134.

Because of such arrangement, if there is entry of a gas refrigerant from the accommodation chamber C1 through the starting point Ls along the facing portion L, the refrigerant will first come into contact with the first O-ring 151. Then, only if the gas refrigerant passes between the first O-ring 151 and the inner circumferential face of the motor case 110, the refrigerant will come into contact with the second O-ring 152.

Herein, the first O-ring 151 to be employed is an O-ring having better refrigerant resistance and/or oil resistance than the second O-ring 152.

Further, the second O-ring 152 to be employed is an O-ring having better sealing performance than the first O-ring 151 at a temperature of, for example, −20° C. or lower.

For example, refrigerant resistance is evaluated by an immersion test using a refrigerant (R1234yf) (JIS K 6258, "Rubber, vulcanized or thermoplastic-Determination of the effect of liquids").

Further, the refrigerant resistance is evaluated by a foaming test in addition to the immersion test. The foaming test is a test to immerse the O-ring in a refrigerant, then heat the O-ring with air, and cut ten portions out of the O-ring to see if a crack is present in the cross-section.

For example, oil resistance is evaluated by an immersion test using a refrigeration oil (POE oil) (JIS K 6258, "Rubber, vulcanized or thermoplastic-Determination of the effect of liquids").

For example, the sealing performance is evaluated by a TR test (JIS K 6261, "Rubber, vulcanized or thermoplastic-Determination of low-temperature properties"). Specifically, the sealing performance is evaluated based on a TR10 value (a temperature at which the shrinkage rate is 10%). The lower this temperature is, the better the sealing performance at low temperatures is. Note that, when an O-ring is used at a temperature lower than the TR10 value, the sealing performance may not be ensured due to a reduction in the rubber elasticity of the O-ring.

An example of the material of the first O-ring 151 selected based on the above evaluation is HNBR, and an example of the material of the second O-ring 152 selected based on the above evaluation is EPDM.

Note that, when the colors of the first O-ring 151 and the second O-ring 152 are made different from each other, the first O-ring 151 and the second O-ring 152 can be easily visibly distinguished from each other.

This can prevent incorrect assembly of respective O-rings.

According to the present embodiment, the following advantageous effects are achieved.

The compressor 10 includes: the annular first O-ring 151 provided about the axis X at a facing portion L where the motor case 110 and the lower case 130 fitted to each other face each other in a plane; and the annular second O-ring 152 provided about the axis X in the facing portion L, the first O-ring 151 is provided at a position closer to the starting point Ls of the facing portion L than the second O-ring 152, the first O-ring 151 has better refrigerant resistance and/or oil resistance than the second O-ring 152, and the second O-ring 152 has better sealing performance than the first O-ring 151 at a temperature of −20° C. or lower. Thus, even when the first O-ring 151 and the second O-ring 152 are exposed to an environment at a temperature of −20° C. or lower due to the operation of the compressor 10, the first O-ring 151, which is provided at a position that is likely to be subjected to contact with the refrigerant, makes it possible to ensure a certain level of sealing performance while suppressing deterioration due to the refrigerant (containing lubricating oil) because of the excellent refrigerant resistance and/or oil resistance of the first O-ring 151, and the second O-ring 152 makes it possible to ensure high sealing performance even in an environment at a temperature of −20° C. because of the excellent sealing performance at low temperatures of the second O-ring 152. In this situation, while the second O-ring 152 has lower refrigerant resistance and/or oil resistance than the first O-ring 151, the second O-ring 152 is less likely to be deteriorated by the refrigerant (less likely to be affected by the refrigerant). This is because only a small amount of the refrigerant passes by the first O-ring 151, which has better refrigerant resistance and/or oil resistance and exhibits a certain level of sealing performance while having lower sealing performance at low temperatures than the second O-ring 152. In short, this is because only a small amount of a refrigerant may come into contact with the second O-ring 152.

As described above, the combination of the first O-ring 151 and the second O-ring 152 whose materials differ from each other enables sealing performance at low temperatures to be maintained for a long period of time.

Further, the use of different colors of the first O-ring 151 and the second O-ring 152 can prevent incorrect assembly of respective O-rings.

Modified Example 1

Figure 3:
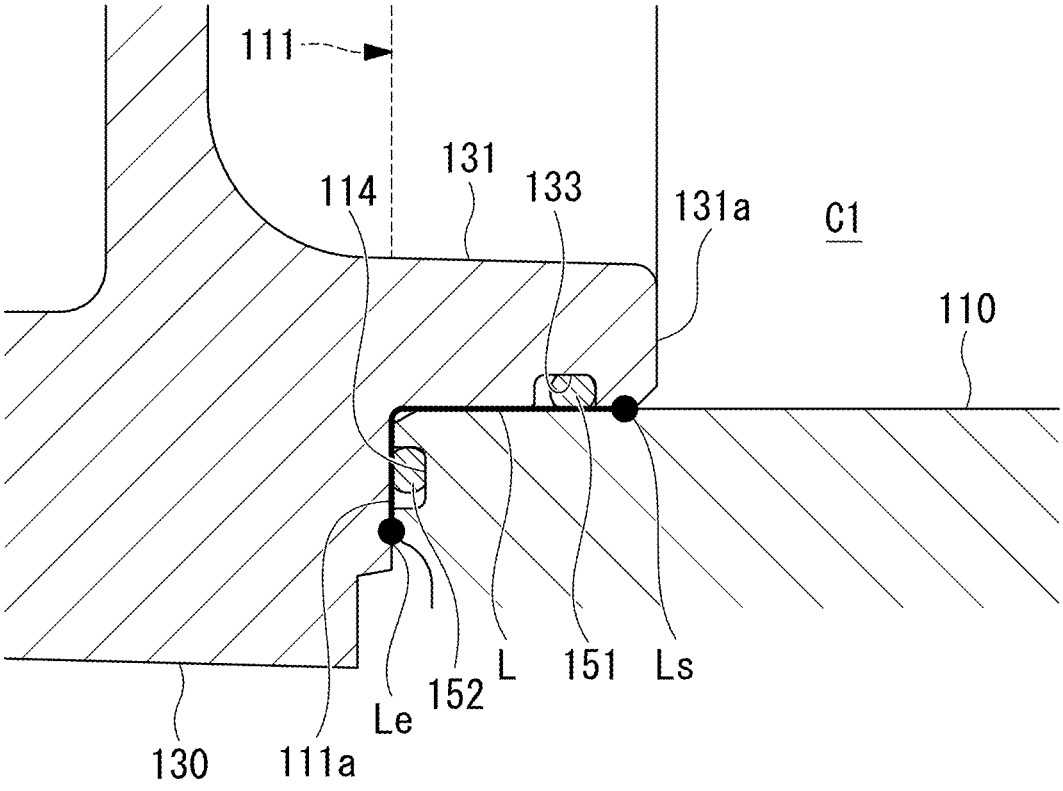
FIG. 3 illustrates a modified example 1 of the part A illustrated in FIG. 1.

As illustrated in FIG. 3, the second O-ring 152 may be provided in an end face 111*a* of the opening 111 of the motor case 110.

In such a case, the first annular groove 133 is formed in the outer circumferential face of the annular protruding portion 131, and a second annular groove 114 is formed in the end face 111*a* of the opening 111 of the motor case 110.

Modified Example 2

Figure 4:
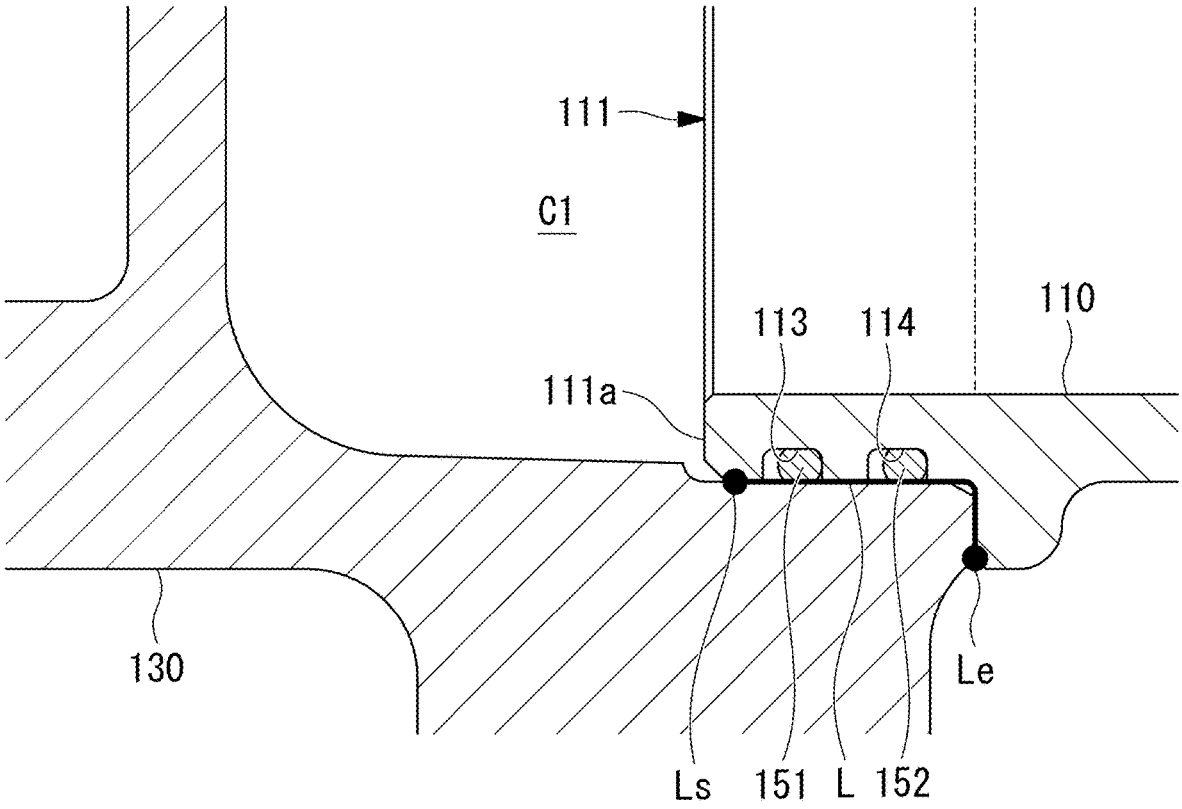
FIG. 4 illustrates a modified example 2 of the part A illustrated in FIG. 1.

As illustrated in FIG. 4, the inner circumferential face of the lower case 130 may be fitted to the outer circumferential face of the motor case 110.

In such a case, a first annular groove 113 and the second annular groove 114 are formed in the outer circumferential face in the portion on the end face 111*a* side of the motor case 110.

Further, the starting point Ls of the facing portion L is located on the end face 111*a* side of the opening 111. Thus, the first annular groove 133 is formed at a position closer to the end face 111*a* of the opening 111 than the second annular groove 134. Thus, the first O-ring 151 is provided at a position closer to the end face 111*a* of the opening 111 than the second O-ring 152.

Modified Example 3

Figure 5:
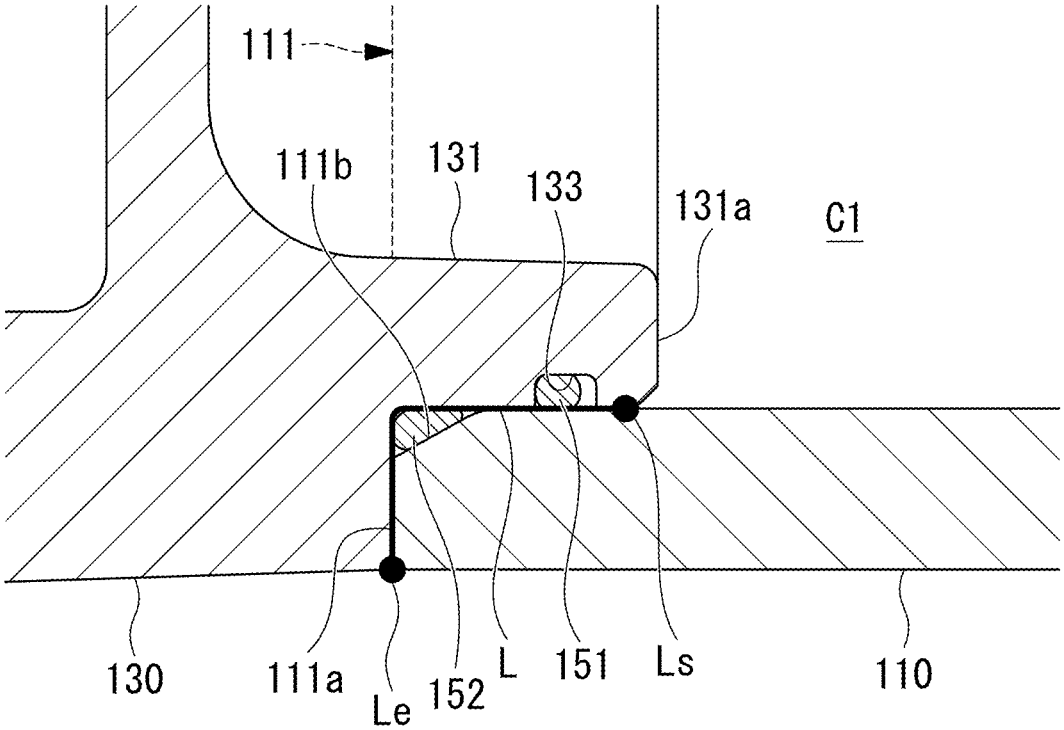
FIG. 5 illustrates a modified example 3 of the part A illustrated in FIG. 1.

As illustrated in FIG. 5, the second O-ring 152 may be provided in a chamfer 111*b* connected to the end face 111*a* of the motor case 110. Note that the chamfer 111*b* is a part of the inner circumferential face of the motor case 110.

In such a case, the first annular groove 133 is formed in the outer circumferential face of the annular protruding portion 131, and the chamfer 111*b* corresponds to the second annular groove 114 or the second annular groove 134.

Note that, in all the embodiments (including modified examples), a component in which annular grooves or the like provided with two O-rings are formed can be arbitrarily selected from the motor case 110 and the lower case 130.

Further, two annular grooves may be formed in the end face 111*a* of the motor case 110 and/or the face of the lower case 130 facing the end face 111*a*, and thereby two O-rings may be provided in these two annular grooves.

The compressor according to the present embodiment as described above is understood as follows, for example.

The compressor (10) according to the first aspect of the present disclosure includes: a cylindrical main case (110) surrounding a compression mechanism (200) about an axis (X), the compression mechanism being configured to compress a refrigerant; a sub-case (130) closing an opening (111) of the main case in a direction of the axis, fitted to an inner circumferential face or an outer circumferential face of the main case, and defining a space (C1) between the main case and the sub-case, the refrigerant being introduced to the space; an annular first seal member (151) provided about the axis at a facing portion (L) where the main case and the sub-case fitted to each other face each other in a plane; and an annular second seal member (152) provided about the axis in the facing portion, the first seal member is provided at a position closer to a starting point (Ls) on the space side of the facing portion than the second seal member, the first seal member has better refrigerant resistance and/or oil resistance than the second seal member, and the second seal member has better sealing performance than the first seal member at a temperature of −20° C. or lower.

According to the compressor of the present aspect, the compressor includes: a annular first seal member provided about the axis at a facing portion where the main case and the sub-case fitted to each other face each other in a plane; and an annular second seal member provided about the axis in the facing portion, the first seal member is provided at a position closer to a starting point on the space side of the facing portion than the second seal member, the first seal member has better refrigerant resistance and/or oil resistance than the second seal member, and the second seal member has better sealing performance than the first seal member at a temperature of −20° C. or lower. Thus, even when the first seal member and the second seal member are exposed to an environment at a temperature of −20° C. or lower due to the operation of the compressor, the first seal member, which is provided at a position that is likely to be subjected to contact with the refrigerant, makes it possible to ensure a certain level of sealing performance while suppressing deterioration due to the refrigerant (containing lubricating oil) because of the excellent refrigerant resistance and/or oil resistance of the first seal member, and the second seal member makes it possible to ensure high sealing performance even in an environment at a temperature of −20° C. because of the excellent sealing performance at low temperatures of the second seal member. In this situation, while the second seal member has lower refrigerant resistance and/or oil resistance than the first seal member, the second seal member is less likely to be deteriorated by the refrigerant (less likely to be affected by the refrigerant). This is because only a small amount of the refrigerant passes by the first seal member, which has better refrigerant resistance and/or oil resistance and exhibits a certain level of sealing performance while having lower sealing performance at low temperatures than the second seal member. In short, this is because only a small amount of a refrigerant may come into contact with the second seal member.

In such a way, the combination of the first seal member and the second seal member whose materials differ from each other enables sealing performance at low temperatures to be maintained for a long period of time.

Further, in the compressor according to the second aspect of the present disclosure, in the first aspect, the first seal member may be arranged to be in contact with the inner circumferential face or the outer circumferential face of the main case, and the second seal member may be arranged to be in contact with the inner circumferential face or the outer circumferential face of the main case.

According to the compressor of the present aspect, the first seal member is arranged to be in contact with the inner circumferential face or the outer circumferential face of the main case, and the second seal member is arranged to be in contact with the inner circumferential face or the outer circumferential face of the main case. Thus, the seal can be ensured with the inner circumferential face or the outer circumferential face of the main case.

Further, in the compressor according to the third aspect of the present disclosure, in the first aspect, the first seal member may be arranged to be in contact with the inner circumferential face or the outer circumferential face of the main case, and the second seal member may be arranged to be in contact with an opening end face of the main case.

According to the compressor of the present aspect, the first seal member is arranged to be in contact with the inner circumferential face or the outer circumferential face of the main case, and the second seal member is arranged to be in contact with an opening end face of the main case. Thus. the seal can be ensured with the inner circumferential face or the outer circumferential face of the main case and the opening end face of the main case.

Further, in the compressor according to the fourth aspect of the present disclosure, in the first aspect, the first seal member may be arranged to be in contact with an opening end face of the main case, and the second seal member may be arranged to be in contact with the opening end face of the main case.

According to the compressor of the present aspect, the first seal member is arranged to be in contact with an opening end face of the main case, and the second seal member is arranged to be in contact with the opening end face of the main case. Thus, the seal can be ensured with the opening end face of the main case.

Further, in the compressor according to the fifth aspect of the present disclosure, in any one of the first aspect to the fourth aspect, the first seal member and the second seal member differ in color from each other.

According to the compressor of the present aspect, the first seal member and the second seal member differ in color from each other, and thus incorrect assembly of respective seal members can be prevented.

REFERENCE SIGNS LIST

10 compressor
100 casing
110 motor case (main case)
111 opening
111*a* end face
111*b* chamfer
113 first annular groove
114 second annular groove
116 suction port
120 upper case
130 lower case (sub-case)

131 annular protruding portion
131*a* end face
133 first annular groove
134 second annular groove
140 inverter cover
151 first O-ring (first seal member)
152 second O-ring (second seal member)
200 compression mechanism
210 fixed scroll
211*a* discharge port
220 orbiting scroll
221 boss part
222 bearing
310 crankshaft
311 shaft body
312 crankpin
400 electric motor
510 main bearing
520 sub-bearing
530 bolt: for upper case
540 screw: for inverter cover
550 bolt: for fixed scroll
C1 accommodation chamber
C2 discharge chamber
C3 compression chamber
X axis

The invention claimed is:

1. A compressor comprising:

a cylindrical main case surrounding a compression mechanism about an axis, the compression mechanism being configured to compress a refrigerant;

a sub-case closing an opening of the main case in a direction of the axis, fitted to an inner circumferential face or an outer circumferential face of the main case, and defining a space between the main case and the sub-case, the refrigerant being introduced to the space;

an annular first seal member provided about the axis at a facing portion where the main case and the sub-case fitted to each other face each other in a plane; and an annular second seal member provided about the axis in the facing portion, wherein the first seal member is provided at a position closer to a starting point on the space side of the facing portion than the second seal member, wherein the first seal member has better refrigerant resistance and/or oil resistance than the second seal member, and wherein the second seal member has better sealing performance than the first seal member at a temperature of −20° C. or lower.

2. The compressor according to claim 1, wherein the first seal member is arranged to be in contact with the inner circumferential face or the outer circumferential face of the main case, and wherein the second seal member is arranged to be in contact with the inner circumferential face or the outer circumferential face of the main case.

3. The compressor according to claim 1, wherein the first seal member is arranged to be in contact with the inner circumferential face or the outer circumferential face of the main case, and wherein the second seal member is arranged to be in contact with an opening end face of the main case.

4. The compressor according to claim 1, wherein the first seal member is arranged to be in contact with an opening end face of the main case, and wherein the second seal member is arranged to be in contact with the opening end face of the main case.

5. The compressor according to claim 1, wherein the first seal member and the second seal member differ in color from each other.

* * * * *